US009067306B1

(12) United States Patent
Lee

(10) Patent No.: US 9,067,306 B1
(45) Date of Patent: Jun. 30, 2015

(54) CAM ACTIVATED CLAMP

(71) Applicant: John Yongki Lee, Springdale, UT (US)

(72) Inventor: John Yongki Lee, Springdale, UT (US)

( * ) Notice: Subject to any disclaimer, the term of this patent is extended or adjusted under 35 U.S.C. 154(b) by 229 days.

(21) Appl. No.: 13/865,898

(22) Filed: Apr. 18, 2013

(51) Int. Cl.

| | |
|---|---|
| ***B25B 1/24*** | (2006.01) |
| ***B25B 1/02*** | (2006.01) |
| ***B25B 7/16*** | (2006.01) |
| ***B25B 1/08*** | (2006.01) |

(52) U.S. Cl.
CPC ... *B25B 1/24* (2013.01); *B25B 1/02* (2013.01); *B25B 7/16* (2013.01); *B25B 1/08* (2013.01)

(58) Field of Classification Search
CPC ..... B25B 1/02; B25B 1/08; B25B 1/2489; B25B 13/24; B25B 5/02; B25B 5/068; B25B 5/08; B25B 5/085; B25B 7/14; B25B 7/16
USPC ..... 269/138, 196, 217, 229, 233, 236, 239, 269/246, 257, 282, 43, 45, 86, 91
See application file for complete search history.

(56) References Cited

U.S. PATENT DOCUMENTS

| | | | | | |
|---|---|---|---|---|---|
| 394,793 | A | * | 12/1888 | Stoecklin | 269/196 |
| 793,551 | A | * | 6/1905 | Swengel | 81/357 |
| 843,969 | A | * | 2/1907 | Shaver | 81/92 |
| 2,061,217 | A | * | 11/1936 | Watcher | 269/170 |
| 2,392,820 | A | * | 1/1946 | Heinrich | 269/170 |
| 2,612,805 | A | * | 10/1952 | Heinrich | 269/167 |
| 2,742,809 | A | * | 4/1956 | Hannes et al. | 81/101 |
| 2,846,907 | A | * | 8/1958 | Sprink | 269/167 |
| 2,954,713 | A | * | 10/1960 | Gaubert | 269/196 |
| 3,389,624 | A | * | 6/1968 | Pooler, Jr. | 81/129 |
| 3,815,894 | A | * | 6/1974 | Olson | 269/167 |
| 4,241,906 | A | * | 12/1980 | Cole | 269/43 |
| 5,002,264 | A | * | 3/1991 | Nimtz | 269/41 |
| 5,443,246 | A | * | 8/1995 | Peterson | 269/283 |

* cited by examiner

*Primary Examiner* — Lee D Wilson
*Assistant Examiner* — Tyrone V Hall, Jr.
(74) *Attorney, Agent, or Firm* — Gurr & Brande, PLLC; Robert A. Gurr

(57) ABSTRACT

A cam activated clamp enables a user with joint pain in hands and wrists to firmly hold an object in place for twisting. The cam activated clamp includes a base frame attached to a counter gripper which is immediately adjacent to a main gripper. The main gripper can travel along a central axis toward the counter gripper unless a locking plate holds the main gripper in a fixed position on the base frame. The user can rotationally activate a cam in order to unlock the main gripper. This allows the user with the joint pain in the hands and wrists to insert the object between the main gripper and the counter gripper and then slide the main gripper proximate the counter gripper and lock the main gripper in place by rotating a cam distant a locking plate which holds the object in place for twisting.

2 Claims, 4 Drawing Sheets

CAM ACTIVATED CLAMP

CROSS REFERENCE TO RELATED APPLICATIONS

This application claims priority to U.S. Provisional Patent Application 61,635,042 filed on Apr. 18, 2012 and U.S. Provisional Patent Application 61/635,045 filed on Apr. 18, 2012.

FIELD OF THE INVENTION

This invention relates to machine tools.

BACKGROUND OF THE INVENTION

Joint pain in the hands and wrists is a serious problem, particularly when one considers the number of twisting motions an individual user attempts in a day. Everything from opening ajar to turning a bolt can be painful giving the squeezing and twisting motions these activities require. Prior art devices have essentially relied upon levers to obtain levels to accomplish the squeezing and twisting motions associated with opening a jar or turning a bolt. However, simple levers offer an inadequate mechanical advantage for holding the desired item in place. Embodiments of the present invention solves this problem.

BRIEF SUMMARY OF THE INVENTION

A cam activated clamp enables a user with joint pain in hands and wrists to firmly hold an object in place for twisting. The cam activated clamp includes a base frame attached to a counter gripper which is immediately adjacent to a main gripper. The main gripper can travel along a central axis toward the counter gripper unless a locking plate holds the main gripper in a fixed position on the base frame. The user can rotationally activate a cam in order to unlock the main gripper. This allows the user with the joint pain in the hands and wrists to insert the object between the main gripper and the counter gripper and then slide the main gripper proximate the counter gripper and lock the main gripper in place by rotating a cam distant a locking plate which holds the object in place for twisting.

BRIEF DESCRIPTION OF THE SEVERAL VIEWS OF THE DRAWINGS

Figure 1:
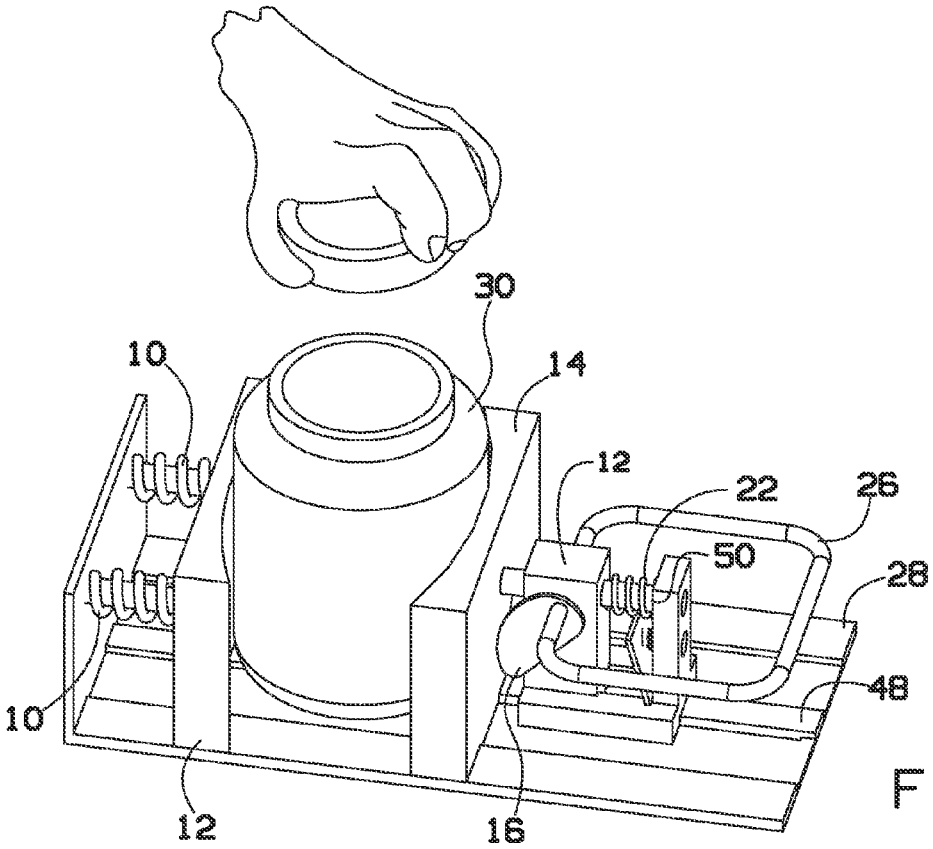

Having thus described the invention in general terms, reference will now be made to the accompanying drawings, which are not necessarily drawn to scale, and wherein:

FIG. 1 is a perspective view of the invention in use.

Figure 2:
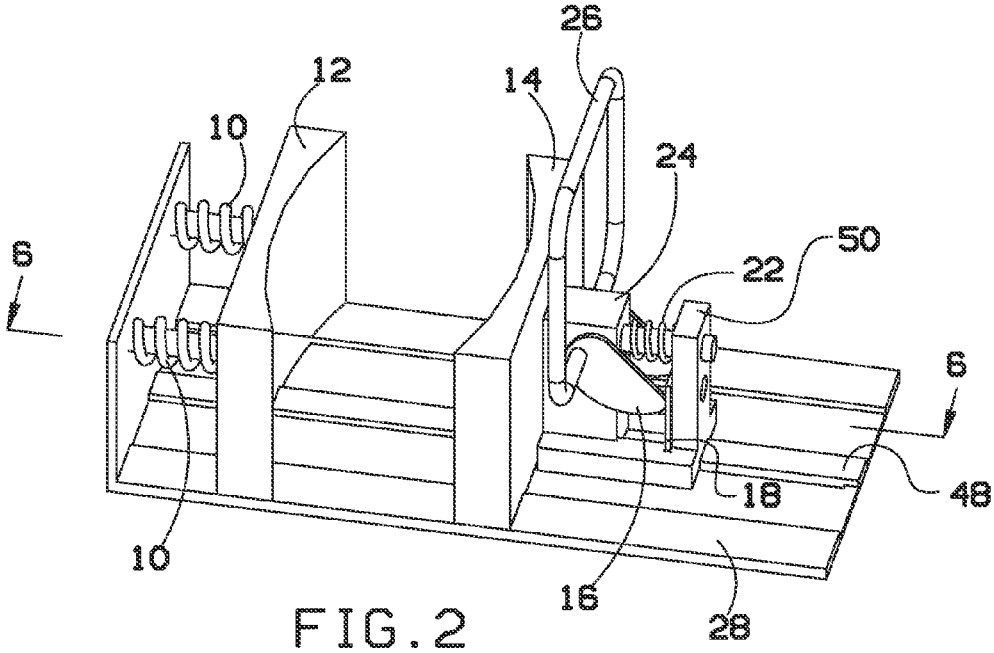

FIG. 2 is a front perspective view of the invention.

Figure 3:
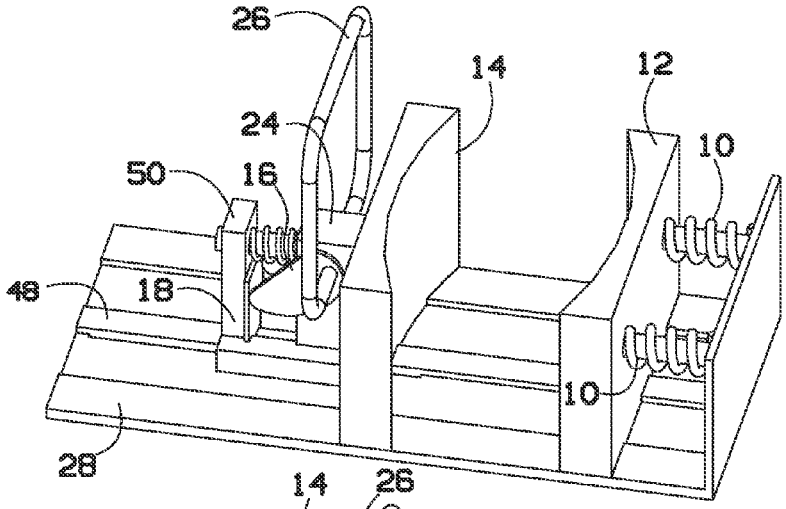

FIG. 3 is a rear perspective view of the invention.

Figure 4:
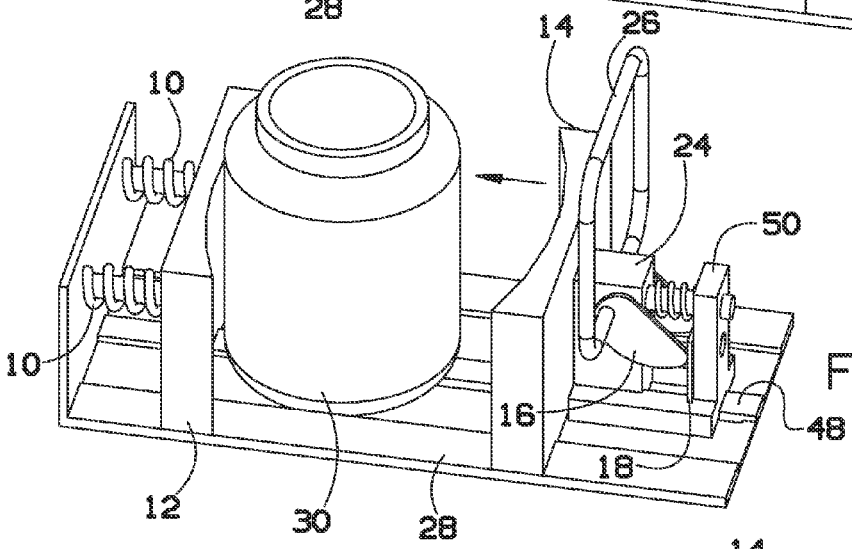

FIG. 4 is a perspective view of the invention illustrating the first step of the clamping procedure.

Figure 5:
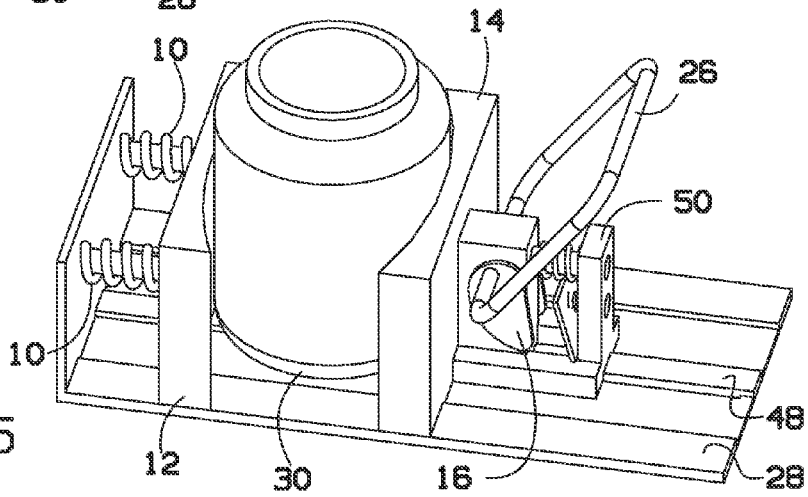

FIG. 5 is a perspective view of the invention illustrating the jar captured prior to the handle and the cam being locked.

Figure 6:
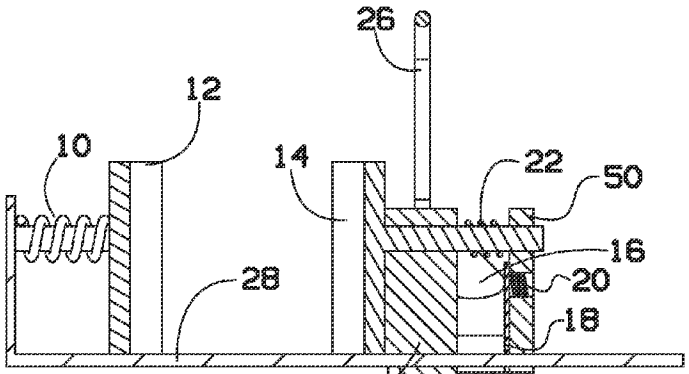

FIG. 6: is a section view taken along line 6-6 in FIG. 2 where the main gripper 14 and the counter gripper 12 are illustrated in the unlocked position.

Figure 7:
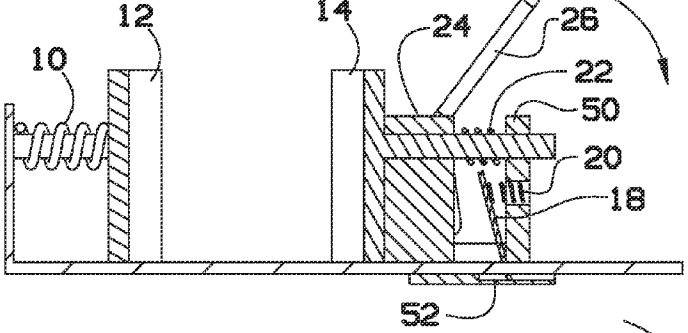

FIG. 7 is a section view of the invention illustrating the main gripper being activated by the cam and the handle.

Figure 8:
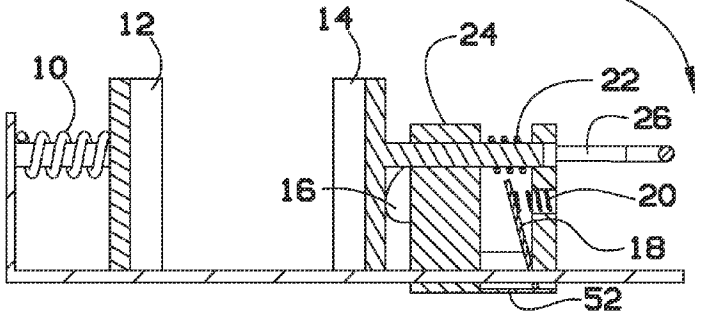

FIG. 8: is a section view of the invention illustrating the main gripper after activation by the cam and the handle.

Figure 9:
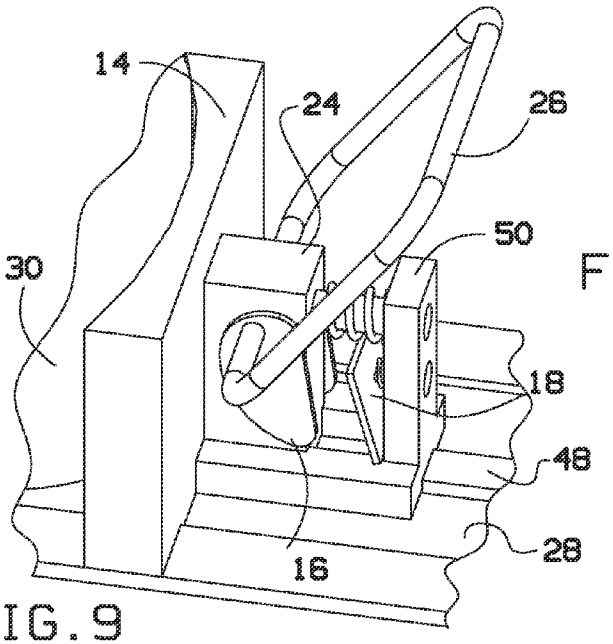

FIG. 9 is a detailed perspective illustrating the cam and the locking plate.

Figure 10:
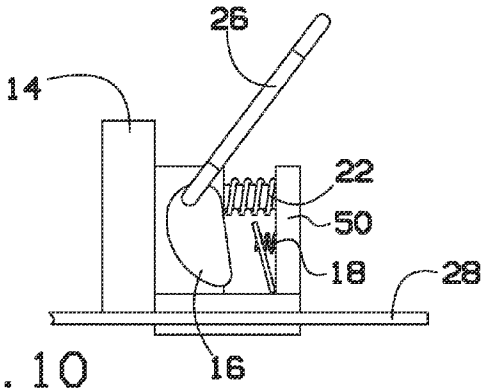

FIG. 10 is a detailed side view illustrating the cam, the locking plate and the main gripper return spring.

Figure 11:
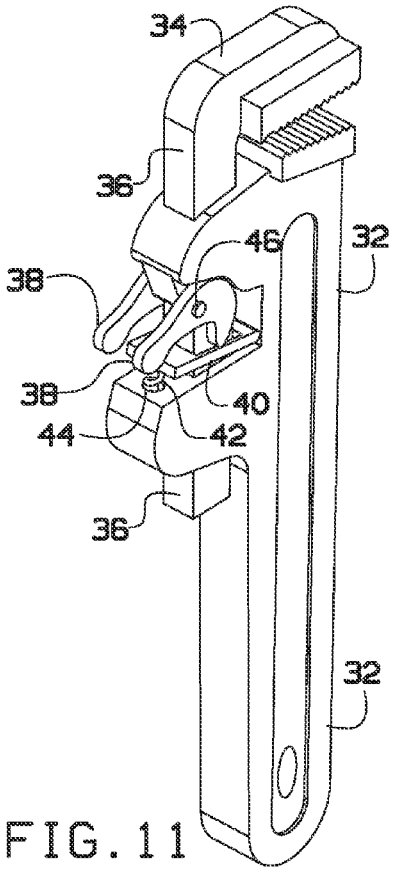

FIG. 11 is a perspective view of an alternate embodiment of the invention.

Figure 12:
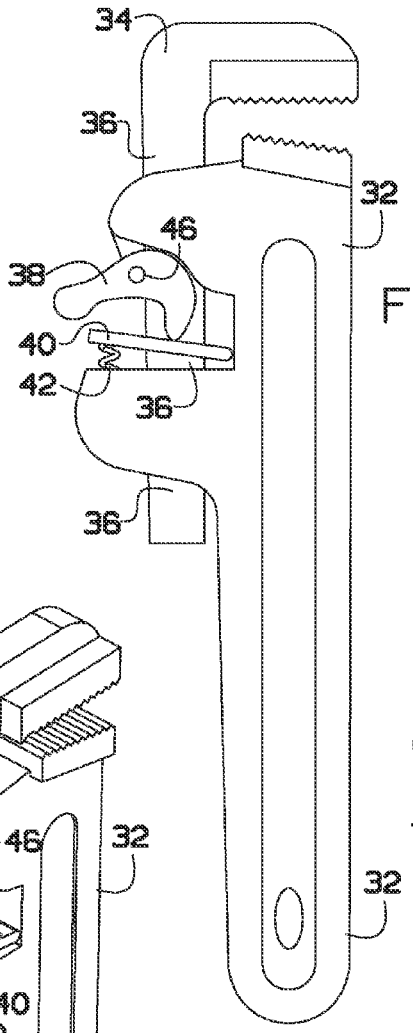

FIG. 12 is a side view of an alternate embodiment of the invention.

Figure 13:
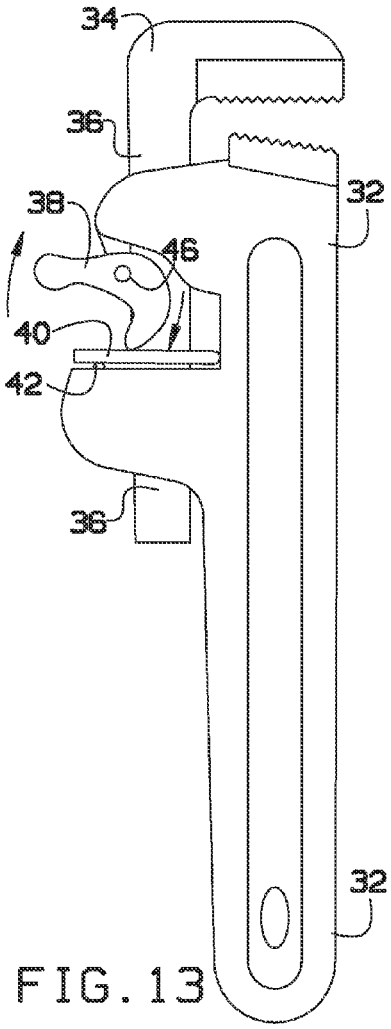

FIG. 13 is a side view of an alternate embodiment of the invention.

DETAILED DESCRIPTION OF THE INVENTION

Embodiments of the present invention overcome many of the obstacles associated with gripping holding and turning objects, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows an embodiment of the cam activated clamp in use. A user desires to twist a threaded object from a threaded post and can do so with a cam activated clamp. The cam activated clamp comprises base frame 28. Base frame 28 is mechanically coupled to first counter pressure compression spring 10 and second counter pressure compression spring 10. The first counter pressure compression spring 10 and the second counter pressure compression spring 10 are mechanically coupled to counter gripper 12. Base frame 28 is immediately adjacent to main gripper 14. Main gripper 14 is T-shaped as shown in FIG. 6, FIG. 7 and FIG. 8 and is mechanically coupled to back plate 50 while being immediately adjacent to main gripper return spring 22. Back plate 50 is displaced from locking plate 18 with locking plate spring 20.

Master block 24 is mechanically coupled to handle 26, where handle 26 is rotationally coupled to cam 16. In FIG. 1, an embodiment of the cam activated clamp is holding jar 30.

Base frame 28 contains guide 48 upon which counter gripper 12, main gripper 14 and master block 24 can laterally slide upon a central axis parallel to guide 48. Base frame 28 comprises cavities 52 which can accommodate locking plate 18. Handle 28 can rotate cam 16 which can either displace main gripper 14 from master block 24 (as shown in FIG. 1 and FIG. 8) or cam 16 can displace locking plate 18 proximate back plate 50 (as shown in FIG. 3, FIG. 4 and FIG. 6).

To create pressure on jar 30, a user places jar 30 immediately adjacent to counter gripper 12 and then slides main gripper 14 along guide 48 proximate jar 30 but such that locking plate 18 is proximate a cavity 52 in base frame 28. This is easiest to accomplish when handle 26 is orthogonal the central parallel axis and cam 16 has displaced locking plate 16 such that locking plate 16 has compressed locking plate spring 20 and is parallel to back plate 50. Alternately as handle 26 rotates clockwise as shown in FIG. 5, FIG. 7, FIG. 9 and FIG. 10, cam 16 rotates distant black plate 50 causing locking plate spring 20 to displace locking plate 18 in an angular manner into cavity 52 creating a wedge that prohibits movement of master block 24 and back plate 50 along the central axis placing those components in a fixed position.

Once master block 24 and back plate 50 are in the fixed position, a user can continue to rotate handle 26 such that handle 26 is parallel to the central axis and cam 16 now displaces main gripper 14 distant master block 24 such that master block 24 compresses main gripper return spring 22 exerting a main gripper return spring force upon main gripper

14 to return main gripper 14 proximate back plate 50. A cam force is equal and opposite to a counter pressure compression spring force on first counter pressure compression spring 10 and second counter pressure compression spring 10 holding jar 30 statically between main gripper 14 and counter gripper 12 such that a user twist the lid from jar 30 with ease and without rotating jar 30. Main gripper return spring 22 is immediately adjacent to back plate 50 to provide additional force on main gripper 14.

FIG. 11, FIG. 12 and FIG. 13 show another embodiment of the invention involving a wrench. Base frame 32 is mechanically coupled to a counter gripper. Base frame 32 further comprises a cavity that allows wrench stem 36 to slide on a central axis. Wrench stem 36 is mechanically coupled to main gripper 34.

Base frame 32 is rotationally coupled to cam 38 about pivot 46. Cam 38 is immediately adjacent to locking plate 40. Locking plate 40 comprises a first end mechanically coupled to a back plate on wrench handle 32 and a second end mechanically coupled to locking plate spring 42. Locking plate spring 42 is mechanically coupled to the back plate via spring hole 44. In this embodiment, base frame 32 is mechanically coupled to the back plate to provide additional leverage on locking plate spring 42.

To create pressure on an object, a user can rotate cam 38 clockwise to displace locking plate 40 proximate the back plate. When locking plate 40 is parallel a back plate, wrench stem 36 can freely slide along the central axis. A user places the object immediately adjacent to the counter gripper and then slides main gripper 34 via wrench stem 36 along the central axis proximate the object until the object is firmly between the counter gripper and main gripper 34. Once the object is firmly between the counter gripper and main gripper 34, the user rotates cam 38 counter clockwise causing spring 42 to displace locking plate 40 distant the back plate in an angular manner creating a wedge that prohibits movement of wrench stem 36 along the central axis placing wrench stem 36 and thus main gripper 34 in a fixed position.

The invention claimed is:

1. A cam activated clamp enables a user with joint pain in hands and wrists to firmly hold an object in place for twisting, the cam activated clamp comprising, a base frame that is mechanically coupled to a counter gripper, the base frame is immediately adjacent to a main gripper which can travel along a central axis proximate and distant the counter gripper unless a locking plate mechanically coupled to a back plate with a locking plate spring is displaced in an angular manner relative the central axis by the locking plate spring acting as a wedge that holds the main gripper in a fixed position on the base frame until the user rotationally activates a cam in order to compress the locking plate spring moving the locking plate parallel the back plate; this allows the user with the joint pain in the hands and wrists to insert the object between the main gripper and the counter gripper and then slide the main gripper proximate the counter gripper and lock the main gripper in place by rotating the cam distant the locking plate which holds the object in place for twisting;

wherein the main gripper is t-shaped which is immediately adjacent to a main gripper return spring where the main gripper return spring is immediately adjacent to the back plate to provide additional force on the main gripper.

2. A cam activated clamp enables a user with joint pain in hands and wrists to firmly hold an object in place for twisting, the cam activated clamp comprising, a base frame that is mechanically coupled to a counter gripper, the base frame is immediately adjacent to a main gripper which can travel along a central axis proximate and distant the counter gripper unless a locking plate mechanically coupled to a back plate with a locking plate spring is displaced in an angular manner relative the central axis by the locking plate spring acting as a wedge that holds the main gripper in a fixed position on the base frame until the user rotationally activates a cam in order to compress the locking plate spring moving the locking plate parallel the back plate; this allows the user with the joint pain in the hands and wrists to insert the object between the main gripper and the counter gripper and then slide the main gripper proximate the counter gripper and lock the main gripper in place by rotating the cam distant the locking plate which holds the object in place for twisting;

wherein the main gripper is t-shaped which is immediately adjacent to a main gripper return spring where the main gripper return spring is immediately adjacent to the back plate and the cam can displace the main gripper distant the main gripper return spring to provide additional force on the main gripper.

* * * * *